US008512926B2

(12) United States Patent
Daimon et al.

(10) Patent No.: US 8,512,926 B2
(45) Date of Patent: Aug. 20, 2013

(54) ELECTROPHOTOGRAPHIC TONER, ELECTROPHOTOGRAPHIC DEVELOPER, TONER CARTRIDGE, AND IMAGE FORMING METHOD

(75) Inventors: Katsumi Daimon, Kanagawa (JP); Yutaka Sugizaki, Kanagawa (JP); Susumu Yoshino, Kanagawa (JP); Hiroshi Nakazawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1094 days.

(21) Appl. No.: 12/046,957

(22) Filed: Mar. 12, 2008

(65) Prior Publication Data

US 2009/0011347 A1 Jan. 8, 2009

(30) Foreign Application Priority Data

Jul. 4, 2007 (JP) ..... 2007-176475

(51) Int. Cl.
*G03G 9/00* (2006.01)

(52) U.S. Cl.
USPC .... 430/109.1; 430/48; 430/108.1; 430/109.4; 430/111.35; 430/137.14; 399/106

(58) Field of Classification Search
USPC ..... 430/48.1, 109.4, 108.9, 108.1, 109.1, 430/111.35, 137.14
See application file for complete search history.

(56) References Cited

U.S. PATENT DOCUMENTS

2002/0042013 A1* 4/2002 Aoki et al. ..... 430/111.4
2004/0265721 A1 12/2004 Matsuoka et al.
2005/0227160 A1 10/2005 Shirai et al.
2005/0245694 A1* 11/2005 Matsumura et al. ..... 525/437
2006/0140681 A1* 6/2006 Yamane ..... 399/258
2006/0204880 A1* 9/2006 Mizutani et al. ..... 430/109.4
2006/0292477 A1* 12/2006 Daimon et al. ..... 430/109.4
2009/0117482 A1 5/2009 Shirai et al.

FOREIGN PATENT DOCUMENTS

JP A 2004-191623 7/2004
JP A 2005-77784 3/2005
JP A-2006-71906 3/2006
JP A 2006-106727 4/2006
JP A-2006-267741 10/2006
JP A-2006-276064 10/2006
JP A-2007-47219 2/2007

OTHER PUBLICATIONS

Sep. 6, 2011 Japanese Office Action issued in Japanese Patent Application No. 2007-176475 (with translation).

* cited by examiner

*Primary Examiner* — Thorl Chea
(74) *Attorney, Agent, or Firm* — Oliff & Berridge, PLC

(57) ABSTRACT

The invention provides an electrophotographic toner having a crystalline polyester resin; a non-crystalline polyester resin; a colorant; and a releasing agent. A resin (i), that is included in a toluene-soluble component of the toner and having a molecular weight of 30,000 to 100,000 as measured by gel permeation chromatography relative to polystyrene standards, has an acid value A. A resin (ii), that is included in a toluene-soluble component of the toner and having a molecular weight of 8,000 to 12,000 as measured by gel permeation chromatography relative to polystyrene standards, has an acid value B. A resin (iii), that is included in a toluene-insoluble component of the toner, has an acid value C. The acid values A, B, and C satisfy the inequation of B>A>C. The invention further provides an electrophotographic developer using the toner, a toner cartridge storing the toner, and an image forming method using the developer.

17 Claims, 1 Drawing Sheet

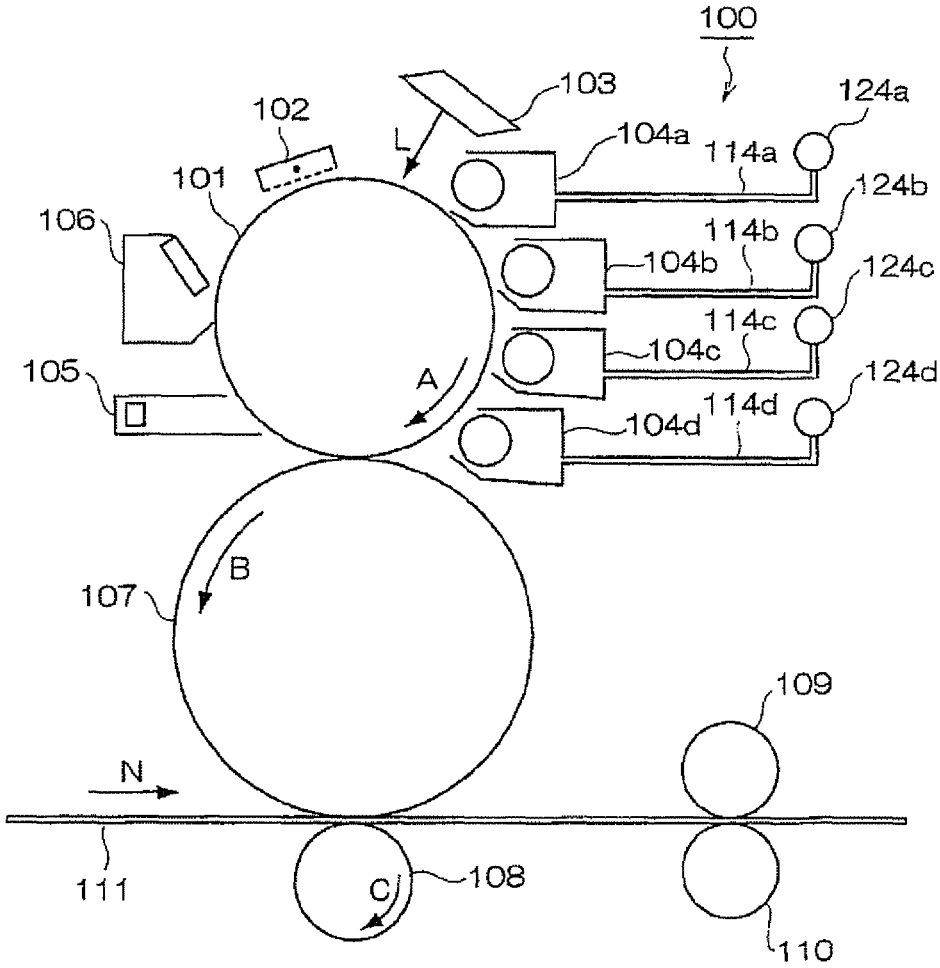
100
103
124a
102
L
104a
114a
101
124b
106
114b
104b
124c
114c
104c
105
A
124d
114d
104d
B
107
109
N
111
108
C
110

ELECTROPHOTOGRAPHIC TONER, ELECTROPHOTOGRAPHIC DEVELOPER, TONER CARTRIDGE, AND IMAGE FORMING METHOD

CROSS-REFERENCE TO RELATED APPLICATION

This application claims priority under 35 USC 119 from Japanese Patent Application No. 2007-176475 filed on Jul. 4, 2007.

BACKGROUND OF THE INVENTION

1. Field of the Invention

The present invention relates to an electrophotographic toner for use in electrophotographic apparatuses which utilize an electrophotographic process such as copying machines, printers, facsimiles, and the like, a production method thereof, an electrophotographic developer, and an image-forming process using the toner.

2. Description of the Related Art

Many electrophotographic methods are already known. Generally, a fixed image is formed after undergoing the plural steps in which a latent image is electrostatically formed by various means on a surface of a photosensitive body (latent image carrier) which utilizes a photoconductive substance, the formed latent image is developed using electrophotographic toner (hereinafter, referred to as simply "toner") to form a toner image, the toner image on the surface of the photosensitive body is transferred onto a surface of a recording material such as paper or the like, and this transferred image is fixed by compression or thermocompression and solvent vapor, etc. Toner remaining on the surface of the photosensitive body is cleaned, as required, by various methods and is again supplied for the aforementioned plural steps.

As a fixing technique for fixing a transfer image which has been transferred onto a surface of a recording material, a heat roll fixing method of inserting a transferrable body onto which a toner image has been transferred between a pair of rolls composed of a heating roll and a pressure roll to fix the image is common. In addition, as a similar technique, a technique in which one or both of the rolls is substituted with a belt is also known. Compared to other fixing means, these techniques provide an image that is firmly fixed at high speed, have a high energy efficiency, and cause minimal damage to the environment due to volatilization of solvent or the like.

On the other hand, a technique for fixing toner using less energy is desired in order to reduce the amount of energy usage in copying machines and printers. For this reason, there is a strong demand for an electrophotographic toner which can be fixed at a lower temperature.

SUMMARY OF THE INVENTION

The present invention provides an electrophotographic toner that enables suppression of streak-form image defects when an image is initially printed after the toner is allowed to stand at high humidity for a long period; an electrophotographic developer comprising the electrophotographic toner; a toner cartridge in which the electrophotographic toner is accommodated; and an image forming process using the electrophotographic developer.

Namely, a first aspect of the present invention provides an electrophotographic toner comprising: a crystalline polyester resin; a non-crystalline polyester resin; a colorant; and a releasing agent, the toner comprising:

a resin (i) included in a toluene-soluble component of the toner and having a molecular weight of about 30,000 to about 100,000 as measured by gel permeation chromatography relative to polystyrene standards, that has an acid value A;

a resin (ii) included in the toluene-soluble component of the toner and having a molecular weight of about 8,000 to about 12,000 as measured by gel permeation chromatography relative to polystyrene standards, that has an acid value B; and a resin (iii) included in the toluene-insoluble component of the toner, that has an acid value C, the acid values A, B, and C satisfying the inequation of B>A>C.

In an exemplary embodiment of the first aspect of the present invention, the crystalline polyester resin has an ester concentration M calculated by the following equation in a range of about 0.07 to about 0.09:

$$\text{Ester concentration } (M) = K/J$$

wherein, in the above equations K represents an ester group number in the crystalline polyester resin; and J represents a number of atoms which constitute the polymer chain of the crystalline polyester resin.

In another exemplary embodiment (13) of the first aspect of the present invention, the electrophotographic toner is formed by an image forming method comprising:

providing a non-crystalline polyester resin particle dispersion liquid having non-crystalline polyester resin particles dispersed therein;

providing a crystalline polyester resin particle dispersion liquid having crystalline polyester resin particles dispersed therein;

providing a colorant particle dispersion liquid having colorant particles dispersed therein;

providing a releasing agent particle dispersion liquid having releasing agent particles dispersed therein;

forming aggregated particles comprising the non-crystalline polyester resin particles, the crystalline polyester resin particles, the colorant particles and the releasing agent particles by mixing the non-crystalline polyester resin particle dispersion liquid, the crystalline polyester resin particle dispersion liquid, the colorant particle dispersion liquid and the releasing agent particle dispersion liquid; and melt-coalescing the aggregated particles by heating.

A second aspect of the present invention provides an electrophotographic developer comprising the electrophotographic toner of the first aspect of the present invention and a carrier.

A third aspect of the present invention provides a toner cartridge, which is attachable to and detachable from an image forming machine having a developing means, and stores a toner to be supplied to the developing means, the toner being the electrophotographic toner of the first aspect of the present invention.

A fourth aspect of the present invention provides an image forming method, comprising:

latent image-forming to form an electrostatic latent image on a surface of a latent image holder;

image forming by developing the electrostatic latent image using an electrophotographic developer held on a surface of a developer holder to form a toner image;

transferring the toner image from the surface of the latent image holder to a surface of a transfer-receiving body; and fixing the transferred toner image to the surface of the transfer-receiving body, the electrophotographic developer being the electrophotographic developer of the second aspect of the present invention.

BRIEF DESCRIPTION OF THE DRAWINGS

FIG. 1 is a schematic view illustrating an example of the image forming device.

DETAILED DESCRIPTION OF THE INVENTION

Use of the toner of the exemplary embodiment reduces the occurrence of streak-form image defects when an image is initially printed after the toner is allowed to stand at high humidity for a long period. In the exemplary embodiment, the expression "high humidity" indicates conditions in which the temperature is about 20° C. or higher and the humidity is about 70% RH or more.

When an electrophotographic image forming device is placed in an office or the like, a lengthy period of time passes in the interval between the last printing job during working hours and printing on the first sheet the next morning; therefore, a streak-form image defect may be generated in an image printed on the first sheet the next morning. It is presumed that this image defect is generated by a deterioration in the cleanliness of the surface of a photoreceptor (latent image holder) of the image forming device caused by toner deposited on a contact region (blade edge region) between the photoreceptor and a cleaning blade contacting the surface of the photoreceptor.

The deposited toner conceivably results from the gradual deposition on the blade edge region of inferior toner contained in the toner in the process of image-formation over the long term. The deposited toner is conceivably toner in which a large amount of crystalline polyester resin is exposed at the toner surface, or toner in which brittle toner or the like is susceptible to being deposited on the blade edge region.

A method having adjusting the acid value of a resin to be mixed with a crystalline polyester in view of enveloping a crystalline polyester resin into toner or controlling the quantity of portions of the crystalline polyester exposed to the surface of toner has been known (for example, JP-A Nos. 2005-077784 and 2006-106727). However, the evenness in composition of the resultant when different materials are mixed with each other is not thought as being sufficient only by the techniques disclosed in the publications. The stability of images over a long term is not also sufficiently secured.

The resin fractions contained in the toner of the exemplary embodiment of the invention satisfy the specific relationship of the acid values. The resin fraction contained in the toluene-insoluble matters may be substantially the crystalline polyester resin, and the resin fraction contained in the toluene-soluble matters may be substantially the non-crystalline polyester resin. In the toner of the exemplary embodiment, the acid value C of the crystalline polyester resin (iii) is lower than the acid value A of a higher molecular weight bodies (the resin (i) having a molecular weight of about 30,000 to about 100,000 relative to polystyrene standards by separating treatment by gel permeation chromatography) out of the non-crystalline polyester resin. Moreover, the acid value A is lower than the acid value B of a lower molecular weight bodies (the resin (ii) having a molecular weight of about 8,000 to about 12,000 relative to polystyrene standards by separating treatment by gel permeation chromatography) out of the non-crystalline polyester resin.

In the production of wet toner, a resin having a high acid value is susceptible to appearing on the surface layer of the toner; therefore, as a rule, when the acid value of a crystalline polyester resin that is intended to be enveloped within the toner is lowered, the envelopablity thereof increases. Furthermore, since the affinity of the crystalline polyester resin with higher molecular weight bodiesof a non-crystalline polyester resin having an acid value close to that of the crystalline polyester resin is raised, when the polyester resins are mixed with each other, the strength of the resultant toner is increased. Even if inferior toner with an increased content of the crystalline polyester resin is produced, the affinity thereof with the higher molecular weight bodies of the non-crystalline polyester resin is high and, therefore, the inferior toner can be imparted with a certain degree of strength. For this reason, it is presumed that the toner of the exemplary embodiment is not easily deposited on a blade edge region.

The difference in affinity with respect to the crystalline polyester resin between higher molecular weight bodies and lower molecular weight bodies of the non-crystalline polyester resin is thought to be slight. However, it is presumed that the difference is important for securing stability over the long term.

In the exemplary embodiment, the acid value of any resin fraction contained in the toner is measured as follows.

About 0.5 g, of the resin fraction is precisely weighed, and the weighed resin is dissolved into 150 ml of tetrahydrofuran while heated if necessary. Several drops of a phenolphthalein indicator is added thereto, and then a 0.1 mol/L solution of potassium hydroxide in ethanol is used to titrate the resultant solution. The last point of the term during which exhibition of slightly red color is continued for 30 seconds is regarded as an end point of the titration. The acid value (A) is calculated from the following equation (2):

$$A=B\times f\times 5.611/S \quad (2)$$

In the equation (2), A represents the acid value (mgKOH/g); B represents the amount (ml) of the 0.1 mol/L solution of potassium hydroxide in ethanol used for the titration; f represents the factor of the 0.1 mol/L solution of potassium hydroxide in ethanol; and S represents the weight (g) of the sample.

As regards the crystalline polyester resin in the exemplary embodiment, the term "crystalline" indicates that in differential scanning calorimetry (DSC), a stepwise endothermic quantity change is not exhibited but a clear endothermic peak is present. Further, when turning the resin into toner, the endothermic peak may have a temperature width of 40 to 50° C.

As regards the non-crystalline polyester resin, the term "non-crystalline" indicates that in differential scanning calorimetry (DSC), only a stepwise endothermic quantity change is exhibited and, in particular, a clear endothermic peak is not present in the calorimetry in a spectrum obtained by raising the temperature of the resin after a thermal hysteresis in which the temperature is raised by one degree and then lowered by one degree is applied to the resin.

The toner of the exemplary embodiment contains at least a crystalline polyester resin, a non-crystalline polyester resin, a colorant, and a releasing agent, and may further contain one or more additional components of necessary. The respective components contained in the toner of the exemplary embodiment will be described hereinafter.

Crystalline Polyester Resin

The crystalline polyester resin is contained as a binder resin in the toner.

In the exemplary embodiment, in the case of a polymer wherein the main chain of a crystalline polyester resin is copolymerized with a different component, this copolymer is also called the crystalline polyester resin as long as the amount of the different component is 50% or less by mass.

About the crystalline polyester resin in the exemplary embodiment, it is desired that the ester concentration M in the crystalline polyester resin which is represented by an equation (3) described below satisfies: $0.07 \leqq M \leqq 0.09$.

$$\text{Ester concentration } (M) = K/J \quad (3)$$

The "ester concentration M" is an index representing the content by percentage of ester groups in the polymer of any crystalline polyester resin. In the equation, K represents the "the ester group number in the polymer", that is, the number of ester bonds contained in the whole of the polymer.

In the equation, J represents the "number of atoms which constitute the polymer chain of the polymer". This is the total number of atoms which constitute the polymer chain of the polymer, including all atoms connected with the ester bonds, but not including atoms in branched moieties in the other constituent regions. In other words, carbon atoms and oxygen atoms originating from carboxyl groups and alcohol groups related to the ester bonds (the number of oxygen atoms in each of the ester bonds being two), and, for example, six carbon atoms in each aromatic ring which constitutes the polymer chain, are included in the calculation of the number of atoms; however, hydrogen atoms in each of the aromatic rings and each alkyl group which constitute the polymer chain, and an atom or atoms in substituents of the hydrogen atom(s), for example, are not included in the calculation of the number of atoms.

Specifically, out of 6 carbon atoms and 4 hydrogen atoms, i.e., 10 atoms in total in an arylene group which partially constitutes the polymer chain, atoms included in the "atoms which constitute the polymer chain of the polymer", for the calculation of J, are the 6 carbon atoms. Even if each of the hydrogen atoms is substituted with any substituent, atoms which constitute the substituent are not included in the "atoms which constitute the polymer chain of the polymer".

When the crystalline polyester resin is a homopolymer made only of groups of a single recurring unit (for example, when the polymer is represented by $H—[OCOR^1COOR^2O—]_n—H$ wherein $R^1$'s and $R^2$'s are each a desired organic group, the chemical formula in the parentheses represents a single recurring unit), two ester bonds are present in the single recurring unit (that is, the ester group number K' in the recurring unit is 2). Thus, the ester concentration M can be calculated from the following equation:

$$M = 2/J'$$

wherein M represents the ester concentration, and J' represents the number of atoms which constitute the polymer chain in the single recurring unit.

When the crystalline polyester resin is a copolymer composed of plural copolymerization units, the ester group number $K^X$ and the number $J^X$ of atoms which constitute the polymer chain are obtained for each of the copolymerization units. These are each multiplied by the copolymerization ratio thereof the resultant values are totaled, and then the resultant totaled values are applied to the equation, whereby the ester concentration can be calculated. For example, for a compound $[(Xa)_a(Xb)_b(Xc)_c]$ in which the copolymerization units are the three units Xa, Xb and Xc and the copolymerization ratios between these units are a/b/c (where a+b+c=1), the ester concentration M thereof can be calculated from the following equation:

$$M = \{K^{Xa} \times a + K^{Xb} \times b + K^{Xc} \times c\} / \{J^{Xa} \times a + J^{Xb} \times b + J^{Xc} \times c\}$$

where M represents the ester concentration; $K^{Xa}$, $K^{Xb}$ and $K^{Xc}$ represent the ester group numbers in the copolymerization units Xa, Xb and Xc, respectively; and $J^{Xa}$, $J^{Xb}$ and $J^{Xc}$ represent the numbers of atoms which constitute the respective polymer chains in the copolymerization units Xa, Xb and Xc.

If the ester concentration is more than 0.09, the electric resistance of the crystalline polyester resin itself becomes low so that a sufficient electrification quantity of the toner is not easily obtained, in particular, at high humidity. If the ester concentration is less than 0.07, the resin is not easily made compatible with the non-crystalline polyester resin so that a toner is not easily formed or the toner or an image therefrom is easily cracked.

The amount of the crystalline polyester resin in the toner of the exemplary embodiment of the invention is preferably in a range of about 4% by mass to about 25% by mass relative to the total of the amount of the crystalline polyester resin, an amount of the non-crystalline polyester resin, which will be detailed in the followings, and an amount(s) of some other resin(s) which can be arbitrarily used (that is, the total of the amount of all binder resin components), more preferably in a range of about 4% by mass to about 15% by mass thereof. When the amount of the crystalline polyester resin in all the binder resin components is about 4% by mass or more, a low-temperature fixable effect can be satisfactorily produced. When the amount is about 25% by mass or less, the electrification quantity at high humidity can be adjusted into a range suitable for development.

The crystalline polyester is a specific polyester prepared from an acid (dicarboxylic acid) component and an alcohol (diol) component. In the description of the polyester resin below, the configurational unit that was an acid component before synthesizing the polyester will be referred to as an "acid-derived component", and the configurational unit that was an alcohol component before synthesizing the polyester as an "alcohol-derived component".

Acid-Derived Component

Examples of the acids for the acid-derived component include various dicarboxylic acids, and the main acid-derived component in the specific polyester is preferably a aliphatic dicarboxylic acid or an aromatic dicarboxylic acid; and in particular, the aliphatic dicarboxylic acid is preferably a linear carboxylic acid.

Examples of aliphatic dicarboxylic acid include oxyalic acid, malonic acid, succinic acid, glutaric acid, adipic acid, pimelic acid, suberic acid, azelic acid, sebacic acid, 1,9-nonane dicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and a lower alkyl ester or an acid-anhydride thereof, being not limiting. Among them, in view of easy availability, sebacic acid, and 1,10-decanedicarboxylic acid are preferable.

A dicarboxylic acid having a double bond can be preferably used to prevent hot offset in the fixing since the whole of the resins can be crosslinked with the double bond. Examples of the dicarboxylic acid include fumaric acid, maleic acid, 3-hexenedioic acid, and 3-octenedioic acid. However, the acid is not limited thereto. Lower alkyl esters and acid anhydrides of these acids may be used. Of these, fumaric acid, maleic acid and so on are preferred from the viewpoint of costs.

In the present invention, an aromatic dicarboxylic acid may be copolymerized. Examples of the aromatic dicarboxylic acid include terephthalic acid, isophthalic acid, orthophthalic acid, t-butylisophthalic acid, 2,6-naphthalinedicarboxylic acid and 4,4'-biphenyldicarboxylic acid. Among them, terephtalic acid, isophtalic acid, and t-butylisopthalic acid, and alkyl esters thereof are preferable because these are easily available, and polymers which are easily emulsified are easily formed. The amount of copolymerization is preferably about 10 constituting mole %.

In this specification, "constituting mole %" is the percentage when the acid-derived constitutional component in all acid-derived constitutional components in a polyester, or the alcohol constitutional component in all alcohol-derived constitutional components in a polyester is taken as 1 unit (mole), respectively.

Alcohol-Derived Constitutional Component

As an alcohol which is to be an alcohol-derived constitutional component, an aliphatic diol is preferable, and a straight-chain type aliphatic diol having 7 to 20 carbon atoms is more preferable.

Since the crystallizability of a polyester resin decreases and a melting temperature is lowered when the aliphatic diol has a branch shape, the toner blocking resistance image storability, and low-temperature fixability are deteriorated in some cases. When the number of carbon atom in the chain is less than 7, in the case where the diol is polycondensed with aromatic dicarboxylic acid, the melting temperature becomes higher, and a low-temperature fixation becomes difficult in some cases. On the other hand, when the number of carbon atom in the chain exceeds 20, the availability of the material becomes difficult practically. It is more preferable that the number of carbon atom in the chain is 14 or less.

When polyester is obtained by polycondensing the diols with aromatic dicarboxylic acid, it is preferable that the number of carbon atom in the chain is an odd. When the number of carbon atom in the chain is an odd, the melting temperature of a polyester resin becomes lower than the case where the number of carbon atom in the chain is an even, and the melting temperature is easily within a value in a numerical value range described later.

Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol, being not limiting. Among them, in view of easy availability, ethylene glycol, 1,4-butanediol, 1,6-hexanediol, 1,9-nonanediol, and 1,19-decanediol are preferable.

An amount of the aliphatic diol-derived constitutional component in all of alcohol-derived constitutional components included in the crystalline polyester resin is about 80 constituting mole % or more, and is more preferably about 90 constituting mole % or more, relative to the total of the amount of all of alcohol-derived constitutional components. Component(s) other than the aliphatic diol-derived constitutional component may be included in the alcohol-derived constitutional components in accordance with necessity.

When a content of the aliphatic diol-derived constitutional component is less than 80 constituting mole %, since the crystallizability of a polyester resin is reduced, and the melting temperature is lowered, the toner blocking resistance, image storability, and low-temperature fixability tend to be deteriorated.

The monomers that can be used have been listed up above; in order for the monomers to be industrially available and give an ester concentration $0.07 \leqq M \leqq 0.09$ to the resultant polyester (equation (3): ester concentration (M)=K/J), the dicarboxylic component is selected from sebacic acid, dodecanedionic acid, and tetradecanedioic acid, and the diol component is selected from 1,6-hexanediol, 1,9-nonanediol, 1,10-decanediol, and 1,12-dodecanediol.

Process for Producing Crystalline Polyester Resin

A process for producing the crystalline polyester resin is not particularly limited. The crystalline polyester resin can be prepared by a general polyester polymerization method in which an acid component is allowed to react with an alcohol component. For example, the crystalline polyester resin can be prepared by selectively using a method such as a direct polycondensation method or a transesterification method, depending on kinds of monomers used therefor. A molar ratio (acid component/alcohol component) when an acid component is allowed to react with an alcohol component varies with reaction conditions or the like, and, therefore, it cannot be unconditionally determined, but usually around 1/1.

Examples of a catalyst which can be used for preparing the crystalline polyester resin include an alkali metal compound such as sodium or lithium, an alkali earth metal compound such as magnesium or calcium, a metal compound such as zinc, manganese, antimony, titanium, zinc, zirconium or germanium, a phosphorous acid compound, a phosphoric acid compound and an amine compound, and specifically, the following compounds are exemplified.

Specific examples of the catalyst include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zilconyl acetate, zirconyl stearate, zirconyl octylate, germanium oxide, triphenyl phosphite, tris (2,4-di-t-butylphenyl)phosphite, ethyltriphenylphosphinium bromide, triethylamine and triphenylamine.

The melting temperature of the crystalline polyester resin thus obtained is preferably in the range of about 60 to about 120° C. and more preferably in the range of about 70 to about 100° C. A crystalline polyester resin having a melting temperature of lower than about 60° C. may tend to cause aggregation of the powder or deterioration of storability of a fixed image. On the other hand, when the melting temperature thereof exceeds about 120° C., the low-temperature fixation may become difficult.

In the invention, the melting temperature of crystalline polyester was determined from the endothermic peak obtained when heated from room temperature to about 150° C. at a programmed heating rate of about 10° C. per minute in a differential scanning calorimeter (DSC).

The molecular weight of the crystalline polyester is measured by GPC. The weight-average molecular weight (Mw) of the crystalline polyester is from about 10,000 to about 35,000, more preferably from about, 15000 to about 30.000. If the Mw is less than about 10,000, the electrification quantity at high humidity is not certainly kept with ease. If the Mw is more than about 30,000, gloss is not easily generated when the toner is fixed at low temperature.

Method of Measuring Molecular Weight of Crystalline Polyester Resin

The molecular weight of the crystalline polyester resin can be determined as follows: The gel permeation chromatography (GPC) system used is "HLC-8120GPC, SC-8020 (both trade names, manufactured by Tosoh Corporation), and the columns used are two "TSK GEL, SUPER HM-H COLUMNs (trade name, manufactured by Tosoh Corporation, 6.0 mm ID×15 cm)", and the eluant is THF (tetrahydrofuran). The measuring conditions are: sample concentration: 0.5%, flow rate: 0.6 ml/min, sample injection: 10 μl, and measurement temperature: 40° C.; and detector: IR detector. The calibration curve is prepared by using ten polystyrene TSK-standard samples A-500, namely: F-1, F-10, F-80, F-380, A-2500, F-4, F-40, F-128, and F-700 (all trade names, manufactured by Tosoh Corporation).

The acid value of the crystalline polyester resin is preferably from about 7 to about 15 mgKOH/g. In the toner of the exemplary embodiment, important is a combination of the crystalline polyester resin with the simultaneously-used non-crystalline polyester resin; thus, the acid value is appropriately selected in accordance with the acid value of the combined non-crystalline polyester resin. When the toner is produced by an emulsifying aggregation process, it is desired from the viewpoint of the control of the production process to produce emulsion particles of the crystalline polyester resin. When the emulsion is produced, the emulsion is not stably obtained with ease if the acid value is less than about 7 mgKOH/g. On the other hand, if the acid value is more than about 15 mgKOH/g, it is indispensable to make the acid value of the non-crystalline polyester resin higher than the value. When a resin having an excessively high acid value is used, there is easily caused a phenomenon that the amount of coarse particles or very fine particles becomes large in the melt-coalescing. Thus, the control of the process unpreferably becomes complicated. The acid value more preferably ranges from about 9 to 1 about 3 mgKOH/g. The acid value may be adjusted by varying the monomer ratio between the charged acid and alcohol.

The resin particle dispersion liquid of the crystalline polyester resin may be prepared by emulsifying/dispersing the resin by aid of adjusting the acid value of the resin or using an ionic surfactant.

When the polyester crystalline resin can be dissolved in an oily solvent having a relatively lower solubility in water, it is possible to prepare a resin particle dispersion of the polyester crystalline by: dissolving the polyester crystalline resin in such an oily solvent; dispersing, in water, the thus-obtained liquid together with an ionic surfactant, a polymer electrolyte and the like by using a dispersing machine such as a homogenizer; and removing the oily solvent from the thus-obtained dispersion by heating or subjecting to reduced pressure.

Non-crystalline Polyester Resin

The non-crystalline polyester is included in the toner of the invention as a binder resin. The non-crystalline polyester is a specific polyester prepared from an acid (dicarboxylic acid) component and an alcohol (diol) component.

Acid-derived Component

Examples of the acids for the acid-derived component include various dicarboxylic acids such as an aromatic carboxylic acid or a aliphatic dicarboxylic acid.

Examples of the aromatic carboxylic acid include terephthalic acid, isophthalic acid, orthophthalic acid, t-butylisophthalic acid, 2,6-naphthalinedicarboxylic acid and 4,4'-biphenyldicarboxylic acid. Among them, terephtalic acid, isophtalic acid, and t-butylisopthalic acid, and alkyl esters thereof are preferable because these are easily available, and polymers which are easily emulsified are easily formed.

Examples of the aliphatic dicarboxylic acid include oxyalic acid, malonic acid, succinic acid, glutaric acid, adipic acid, pimelic acid, suberic acid, azelic acid, sebacic acid, 1,9-nonane dicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and a lower alkyl ester or an acid-anhydride thereof.

Fumaric acid, maleic acid or cyclohexanedicarboxylic acid may also be used to adjust the glass transition temperature. To adjust the compatibility, it is preferable to use a dicarboxylic acid having, in its side chain, a long alkyl group, such as hexenylsuccinic acid, dodecenylsuccinic acid, or octadecenylsuccinic acid. In order to incorporate a crosslinked structure into the component, trimellitic acid, trimellitic anhydride, 1,3,5-benzenetricarboxylic acid or the like is used.

Considering the adjustment of the glass transition temperature of the resin, costs and the like, it is preferable to use terephthalic acid, isophthalic acid or fumaric acid as a base, use dodecenylsuccinic acid or octadecenylsuccinic acid as a copolymerizable monomer to adjust the compatibility with the crystalline polyester resin, and use trimellitic anhydride or the like as another copolymerizable monomer to adjust the crosslinking degree.

Alcohol-Derived Component

Examples of the alcohol-derived component include aliphatic diols such as ethylene glycol, diethylene glycol, triethylene glycol, propylene glycol, butanediol, hexanediol, 1,8-octanediol, 1,9-nonanediol, 1,10-decanediol, 1,12-dodecanediol, 1,20-eicosanediol, neopentyl glycol, and glycerin; alicyclic diols such as cyclohexanediol, cyclohexanedimethanol, and hydrogenated bisphenol A; and aromatic diols such as an ethylene oxide adduct of bisphenol A, and a propylene oxide adduct of bisphenol A. From these polyhydric alcohols, one or more may be used. Of the polyhydric alcohols, aromatic diols and alicyclic diols are preferred, and aromatic diols are more preferred. In order to keep a good fixability of the toner certainly, it is allowable to use a trihydric or higher-hydric alcohol, that is, a polyhydric alcohol (such as glycerin, trimethylolpropane, or pentaerythritol), for giving a crosslinked structure or a branched structure, together with the diol. If necessary, a monoacid such as acetic acid or benzoic acid, or a monohydric alcohol such as cyclohexanol or benzyl alcohol may be used to attain the adjustment of the acid value or the hydroxyl value, or some other purpose.

The non-crystalline polyester can be prepared from any combination of the above-described monomer components according to the known methods such as those described in "Polycondensation" (Kagaku-dojin Publishing Company (1971)), "Experiments in Polymer Science, Polycondensation and Polyaddition" (Kyoritsu Shuppan Co., Ltd. (1980)), "Polyester Resin Handbook" (Nikkankogyo Shimbun Ed., (1988)), or the like; and it may be prepared, for example, by an ester exchange method, a direct polycondensation method, or the like, or by a combination of any of these methods.

The non-crystalline polyester resin preferably contains two or more polyesters having different molecular weights. For example, when two polyesters are used, the polyester having a lower molecular weight (L resin) preferably has a weight-average molecular weight of about 9,000 to about 20,000, the molecular weight being measured by GPC. If the molecular weight is less than about 9,000, offset may be easily caused in high temperature fixation. If the molecular weight is more than about 20,000, gloss may not be easily expressed in low temperature fixation. On the other hand, the polyester having a higher molecular weight species (H resin) preferably has a weight-average molecular weight of about 25,000 to about 55,000. If the molecular weight is more than about 55,000, gloss may not be easily expressed in high temperature fixation or the fixing temperature may become high.

The acid value of the L resin among the non-crystalline polyesters is preferably from about 13 to about 20 mgKOH/g, and that of the H resin is preferably from about 10 to about 15 mgKOH/g.

The resin particle dispersion liquid of the non-crystalline polyester resin can be easily prepared by emulsifying and dispersing the resin into water. While any conventionally-known emulsifying method may be used for producing composite particles composed of two non-crystalline polyester resins having different molecular weights, phase inversion emulsification is effective in view of obtaining a sharp particle size distribution and a volume-average particle diameter of about 0.08 to about 0.40 μm easily.

The phase inversion emulsification may be carried out as follows. The resin is dissolved into a single amphipathic organic solvent or a solvent formed by mixing plural amphipathic solvents to prepare an oil phase. While the oil phase is stirred, a small amount of a basic compound is dropwise added thereto. Furthermore, water is dropwise added thereto bit by bit while the phase is stirred. In this way, water droplets are taken into the oil phase. When the added amount of the water exceeds a certain amount, the oil phase and the water phase are reversed so that the oil phase is turned to oil droplets. Thereafter, the resultant is subjected to solvent-removing under a reduced pressure, thereby yielding an aqueous liquid of resin dispersion.

Composite particles composed of two non-crystalline polyester resins having different molecular weights csn be prepared by simultaneously charging and dissolving the different resins into an organic solvent or a mixure solvent.

The "amphipathic organic solvent" herein means an organic solvent having a water solubility of about 5 g/L or more, preferably about 10 g/L at 20° C. If the solubility is less than about 5 g/L, the effect of accelerating the treatment for making the system aqueous may be poor. Thus, the resultant resin-dispersed aqueous liquid also may have a problem of having a poor storage stability.

Examples of the amphipathic organic solvent include alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol, or cyclohexanol; ketones such as methyl ethyl ketone, methyl isobutyl ketone, ethyl butyl ketone, cyclohexanone, or isophorone; ethers such as tetrahydrofuran or dioxane; esters such as ethyl acetate, n-propyl acetate, isopropyl acetate, n-butyl acetate, isobutyl acetate, sec-butyl acetate, 3-methoxybutyl acetate, methyl propionate, ethyl propionate, diethyl carbonate or dimethyl carbonate; glycol compounds such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate or dipropylene glycol monobutyl ether; and others such as 3-methoxy-3-methylbutanol, 3-methoxybutanol, acetonitrile, dimethylformamide, dimethylacetoamide, diacetone alcohol or ethyl acetoacetate. These solvents may be used alone or in the form of a mixture of two or more thereof.

The polyester resin used in one exemplary embodiment of the invention is neutralized with a basic compound when dispersed into the aqueous medium. The neutralizing reaction of the carboxyl groups of the polyester resin with the basic compound functions as force for making the dispersion be aqueous, and further electric repulsive force between the carboxyl anions generated thereby enables preventing the particles from aggregating.

Examples of the basic compound include ammonia and an organic amine compound having a boiling temperature of about 250° C. or lower. Preferable examples of the organic amine compound include triethylamine, N,N-diethylethanolamine, N,N-dimethylethanolamine, aminoethanolamine, N-methyl-N,N-diethanolamine, isopropylamine, iminobispropylamine, ethylamine, diethylamine, 3-ethoxypropylamine, 3-diethylaminopropylamine, sec-butylamine, propylamine, methylamninopropylamine, dimethylaminopropylamine, methyliminobispropylamine, 3-methoxypropylamine, monoethanolamine, diethanolamine, triethanolamine, morpholine, N-methylmorpholine, and N-ethylmorpholine.

The amount of the basic compound being added for the neutralization is such that the carboxyl groups can be at least partially neutralized and accords to the amount of the carboxyl groups contained in the polyester resin. Namely, the addition amount of the basic compound is preferably in about 0.2 to about 9.0 times equivalent to the amount of the carboxyl groups, more preferably about 0.6 to about 2.0 times equivalent to the amount thereof. If the added amount is less than about 0.2 time equivalent to the amount of the carboxyl groups, the effect based on the addition of the basic compound may not be achieved. If the added amount is more than about 9.0 times equivalent to the amount, the particle diameter distribution becomes broad so that a good resin-dispersion liquid may not be obtained. This would be because the hydrophilicity of the oil phase increases excessively.

The amount by percentage of the non-crystalline polyester resin in the toner of the exemplary embodiment is preferably from about 1 to about 20% by mass, and is more preferably from 2 to 10% by mass, relative to the total amount of the crystalline polyester resin, the non-crystalline polyester resin, and optional some other resin(s) (that is, the total amount of all binder resin components).

In the exemplary embodiment, the acid value A of a resin fraction fractionally collected by gel permeation chromatography and having a molecular weight of about 30,000 to about 100,000 out of resin fractions contained in toluene-soluble matters in the toner, the acid value B of a resin fraction collected in the same manner and having a molecular weight of about 8,000 to about 12,000, the molecular weights being each a molecular weight converted to that of polystyrene, and the acid value C of a resin fraction contained in toluene-insoluble matters in the toner satisfy the specific relationship of the acid values. The resin fraction contained in toluene-insoluble matters, referred to herein, may substantially correspond to the crystalline polyester resin. The resin fraction having a molecular weight of about 30,000 to about 100,000 and that having a molecular weight of about 8,000 to about 12,000 correspond to the H resin and the L resin, respectively. It is preferable to use a resin having an acid value B of about 13 to about 20 mgKOH/g as the L resin, a resin having an acid value A of about 10 to about 15 mgKOH/g as the H resin, and a resin having an acid value C of about 9 to about 13 mgKOH/g as the crystalline polyester resin, so that these acid values satisfy the relationship of B>A>C.

The toner of the exemplary embodiment may contain, as a binder resin, an additional resin other than the crystalline polyester resin and the non-crystalline polyester resin. Specific examples of the other resin include polystyrene resin, styrene-acrylic copolymer resin, epoxy resin, silicone resin, polyamide resin, and polyurethane resin.

The amount by percentage of the additional resin in the toner of the exemplary embodiment is preferably from about 1 to about 20% by mass, and is more preferably from about 2 to about 10% by mass, relative to the total amount of the crystalline polyester resin, the non-crystalline polyester resin, and the other resin (that is, all the binder resin components).

Releasing Agent

Examples of the releasing agent that may be used in the exemplary embodiment include mineral waxes, petroleum waxes and natural gas waxes such as montan wax, ozocerite, ceresin, paraffin wax, microcrystalline wax, and Fischer Tropsch wax, and modified products thereof; low molecular weight polyolefins such as polyethylene, polypropylene, or polybutene; silicones which are heated to exhibit a softening temperature; aliphatic acid amides such as oleic amide, eruic amide, ricinoleic amide, or stearic amide; plant waxes such as carnauba wax, rice wax, candelilla wax, tallow, or jojoba oil; and animal waxes such as beeswax. However, the releasing agent is not particularly limited. Examples of a modification aiding component that can be used in the exemplary embodiment include higher alcohols having 10 to 18 carbon atoms, mixtures thereof, and higher aliphatic acid mono glycerides having 16 to 22 carbon atoms, and mixtures thereof. A combination of two or more selected from these substances may be used in the exemplary embodiment of the invention.

The releasing agent particle dispersion liquid can be prepared by dispersing the releasing agent together with an ionic surfactant or a polymeric electrolyte such as a polymeric acid or a polymeric base into water, and then making the resultant dispersion into particles by means of an apparatus for heating the dispersion to equal or higher than the melting temperature of the releasing agent while applying a large shearing force thereto. Examples of the apparatus for dispersing the releasing agent into the form of fine particles by action of a mechanical means include a MANTON-GOLIN high-pressure homogenizer (trade name, manufactured by Golin Co.), a continuous-mode ultrasonic homogenizer (manufactured by Nippon Seiki Co., Ltd.), a Nanomizer (manufactured by Nanomizer Co.), a Micro-Fluidizer (manufactured by Mizuho Co.comltd.), a Harrel homogenizer, a slusher (manufactured by Mitsui Mining Co., Ltd.), and a Cabitron (manufactured by Eurotec, Ltd.).

The releasing agent is contained in the toner preferably in an amount of about 3 to about 30% by mass, and is more preferably from about 5 to about 15% by mass, relative to the total amount of the toner. When the contained amount is more than about 3% by mass, a sufficient fixation stability may be obtained. When the amount is less than about 30% by mass, filming on a photoreceptor surface may not be easily generated so that an inconvenience that the fixed image is easily broken may not be easily caused.

Colorant

The colorant used in the exemplary embodiment may be a known colorant such as a black pigment, a yellow pigment, a red pigment, or a blue pigment.

Examples of the black pigment include carbon black and magnetic powder.

Examples of the yellow pigment include Hansa yellow, Hansa yellow 10G, Benzidine yellow G, Benzidine yellow GR, Threne yellow, Quinoline yellow, and Permanent yellow NCG. Examples of red pigment include Bengal, Watchung red, Permanent red 4R, Lithol red, Brilliant crmine 3B, Brilliant carmine 6B, Du Pont oil red, Pyrazolone red, Rhodamine B lake, Lake red G, Rose bengal, Eosine red, and Alizarin lake.

Examples of the blue pigment include Berlin blue, cobalt blue, Alkali lake blue, Victoria blue lake, Fast sky blue, Indanthrene blue BC, Aniline blue, Ultramarine blue, Chalcoil blue, Methylene blue chloride, Phthalocyanine blue, Phthalocyanine green, and Malachite oxalate. These may be used in a mixture of any of them, and may be used in a solid solution state.

These colorants can be dispersed by a known method. Preferable examples of an apparatus for dispersing the colorants include a medium-type dispersing machine such as a rotary shearing type homogenizer, a ball mill, a sand mill or an attriter, and a high pressure-counter collision type disperser.

These colorants can be used to prepare a colorant particle dispersion liquid by dispersing these colorants into an aqueous solvent by use of the homogenizer with an ionic surfactant having a polarity.

The colorant can be selected from the viewpoint of the hue angle, the chroma, the brightness, the weather resistance, the OHP transmisivity, and the dispersibility in a toner. The addition amount of the colorant(s) to the toner of the exemplary embodiment is preferably from about 4 to about 20 parts by mass for 100 parts by mass of the binder resins contained in the toner.

An electrification controlling agent may be added to the toner of the exemplary embodiment in order to improve and stabilize the electrification characteristic further. Various generally-used electrification controlling agents may be used as the electrification controlling agent in the exemplary embodiment, and examples thereof include quaternary ammonium salt compounds, nigrosin compounds, dyes each made of a complex of aluminum, iron, chromium or the like, and triphenylmethane pigments. Materials slightly soluble in water are preferable from the viewpoints of the control of the ionic strength which affects the stability of the aggregated particles and the reduction of pollution due to waste water.

When inorganic particles are added to the toner of the exemplary embodiment as the electrification controlling agent under a wet process, examples of the inorganic particles include inorganic particles of any kind that can be usually used for external additives added to toner surfaces. Specific examples of the inorganic particles include silica, alumina, titania, calcium carbonate, magnesium carbonate, and tricalcium phosphate particles. In this case, the inorganic particles may be used in the state that the particles are dispersed in a solvent by using an ionic surfactant, a polymeric acid, a polymeric base or the like.

For the purpose of imparting flowability and improving cleaning property of the toner, inorganic particles such as silica, alumina, titanium oxide or calcium carbonate and resin particles such as vinyl resin particles, polyester particles or silicone particles can be used as a flowability imparting additive or a cleaning additive by shearing these in a dried condition and adding the resultant to the toner surface.

Specific examples of the inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Among these, silica particles and titanium oxide particles are preferable. The surface of each of the inorganic particles is preferably hydrophobilized in advance. The hydrophobilization is effective not only for improving powder fluidity but also for resistance against dependency of charging to environment and carrier contamination.

The hydrophobilization treatment can be conducted by immersing the inorganic oxide particles into an agent for giving hydrophobicity. The hydrophobilizing agent is not particularly limited, and examples thereof include a silane coupling agent, silicone oil, a titanate based coupling agent, and an aluminum based coupling agent. These may be used alone or in combination of two or more thereof. Of these agents, a silane coupling agent is preferable.

Examples of the silane coupling agent include chlorosilane, alkoxysilane, silazane and special silylation agents. Specific examples of the silane coupling agents include methyltrichlorosilane, dimethyldichlorosilane, trimethylchlorosilane, phenyltrichlorosilane, diphenyldichlorosilane, tetramethoxysilane, methyltrimethoxylsilane, dimethyldimethoxysilane, phenyltrimethoxylsilane, diphenyldimethoxysilane, tetraethoxysilane, methyltriethoxysilane, dimethyldiethoxysilane, phenyltriethoxysilane, diphenyldiethoxysilane, isobutyltriethoxylsilane, decyltrimethoxylsilane, hexamethylsilazane, N,O-(bistrimethylsilyl) acetamide, N,N-bis(trimethylsilyl)urea, tert-butyldimethylchlorosilane, vinyltrichlorosilane, vinyltrimethoxylsilane, vinyltriethoxysilane, γ-methacryloxypropyltrimethoxylsilane, β-(3,4 epoxycyclohexyl)ethyltrimethoxylsilane, γ-glycidoxypropyltrimethoxylsilane, γ-glycidoxypropylmethyldiethoxysilane, γ-mercaptopropyltrimethoxylsilane, and γ-chloropropyltrimethoxylsilane. While the amount of the hydrophobilizing agent cannot be simply determined since it varies based on the kind of the inorganic oxide particles, it is generally in a range of approximately 1 to 50 parts by mass relative to 100 parts by mass of the inorganic oxide particles.

The volume-average particle diameter and the volume-average particle diameter distribution of the toner are determined as follows.

A cumulative distribution curve is drawn from the smallest diameter by plotting the volume-average number in each divided particle diameter range (channel) from the particle diameter distribution measured by using a COULTER MULTISIZER II (trade name, manufactured by Beckmann-Coulter), and the cumulative volumetric particle diameter at cumulative 16% is defined as volume-average particle diameter D16v, the cumulative volumetric particle diameter at cumulative 50% as volume-average particle diameter D50v, and the cumulative volumetric particle diameter at cumulative 84% as volume-average particle diameter D84v. Based on these values, the volume-average diameter distribution index (GSDv) is determined as (D84v)/(D16v). Volume-average diameters of other components can be also calculated in the same manner.

While the toner of the exemplary embodiment of the invention can be formed by using any processes, the toner is preferably a method having at least: providing a non-crystalline polyester resin particle dispersion liquid having non-crystalline polyester resin particles dispersed therein; providing a crystalline polyester resin particle dispersion liquid having crystalline polyester resin particles dispersed therein; providing a colorant particle dispersion liquid having colorant particles dispersed therein; providing a releasing agent particle dispersion liquid having releasing agent particles dispersed therein; forming aggregated particles comprising the non-crystalline polyester resin particles, the crystalline polyester resin particles, the colorant particles and the releasing agent particles by mixing the non-crystalline polyester resin particle dispersion liquid, the crystalline polyester resin particle dispersion liquid, the colorant particle dispersion liquid and the releasing agent particle dispersion liquid; and melt-coalescing the aggregated particles by heating. The toner obtained by the method has a spherical shape or a nearly spherical shape and is thus preferable. Images which are formed by using the toner obtained by the method may have excellent reproductivity of fine lines.

The non-crystalline polyester resin particles used in the production of the toner may be a mixture of at least two non-crystalline polyester resins different from each other in weight-average molecular weight. In this case, the non-crystalline polyester resin particle dispersion liquid can be prepared by mixing the two or more non-crystalline polyester resins with each other and then emulsifying the mixture.

The toner of the exemplary embodiment may have a core-shell structure. The toner particles having a core-shell structure can be formed by firstly forming core aggregated particles in the process of the aggregated particle forming and then forming a shell layer containing the resin particles on the surface of each of the core aggregated particles so as to yielding core-shell aggregated particles.

In the process for the melt-coalescing of the core-shell aggregated particles, the core-shell aggregated particles can be heated to equal to or higher than the glass transition temperature of the resin (binder resin) which constitutes the core aggregated particles or the shell layer, thereby melt-coalescing the particles.

When the method is used to produce the toner, the obtained toner may be a toner in which the releasing agent is satisfactorily dispersed and the polyester resins are less exposed to the toner surface.

The non-crystalline polyester resin particle dispersion liquid, the crystalline polyester resin particle dispersion liquid, the colorant particle dispersion liquid, and the releasing agent particle dispersion liquid are firstly prepared for forming of the aggregated particles.

Next, the non-crystalline polyester resin particle dispersion liquid, the crystalline polyester resin particle dispersion liquid, the colorant particle dispersion liquid, and the releasing agent particle dispersion liquid are mixed for hetero-aggregating the non-crystalline polyester resin particles, the crystalline polyester resin particles, the colorant particles, and the releasing agent particles, thereby forming aggregated particles (core aggregated particles) having a diameter close to a desired toner diameter and containing the non-crystalline polyester resin particles, the crystalline polyester resin particles, the colorant particles, and the releasing agent particles.

Further, a resin particle dispersion liquid containing resin particles is applied to adhere the resin particles onto the surface of the core aggregated particles, thereby forming a coating layer (shell layer) having a desired thickness so as to yield aggregated particles (core-shell aggregated particles) having a core-shell structure wherein the shell layer is formed on the surface of each of the core aggregated particles. The resin particles used to form the shell layer may be the same as or different from the polyester resin particles used to form the core aggregated particles.

The particle diameter of each of the non-crystalline polyester resin particles, the crystalline polyester resin particles, the colorant particles, and the releasing agent particles, which are used in the aggregated particle forming, is preferably about 1 μm or less, and is more preferably from about 100 nm to about 300 nm in order to easily adjust the toner diameter and the particle size distribution into desired values.

When the core aggregated particles are formed, the amounts of ionic surfactants (dispersing agents) having two polarities and contained in the non-crystalline polyester resin particle dispersion liquid, the crystalline polyester resin particle dispersion liquid, or the colorant particle dispersion liquid can be made unbalanced in advance. For example, an inorganic metal salt such as calcium nitrate or a polymer made from an inorganic metal salt such as polyaluminum chloride can be used for ionic neutralization and then the resultant is heated at a temperature equal to or lower than the glass transition temperature of the non-crystalline polyester resin particles, whereby the core aggregated particles can be produced.

When the shell layer is formed, a resin particle dispersion liquid treated with a dispersing agent having a polarity and an amount for compensating for the unbalance between the amounts of the dispersing agents having opposite polarities is added to the solution containing the core aggregated particles and, if necessary, the resultant is then slightly heated at a temperature equal to or lower than the glass transition temperature of the resin particles used to form the core aggregated particles or the shell layer, whereby the core-shell aggregated particles can be produced. The formation of the core aggregated particles and the shell layer may be carried out through repeating plural steps resulted by dividing the formation process to be a stepwise one.

Next, in the melt-coalescing, the core-shell aggregated particles are heated in the solution up to a temperature equal to or higher than the glass transition temperature of the resin particles contained in the core-shell aggregated particles (the glass transition temperature of the resin having the highest glass transition temperature), so as to melt-coalesce the particles, thereby yielding a toner.

After finishing the melt-coalescing, the toner can be subjected to known washing, solid-liquid separating, and drying processes to yield a dried toner.

In the washing, it is preferable to subject the toner to substitution washing with ion exchange water from the viewpoint of the electrification characteristic. While the solid-liquid separating is not particularly limited, it is preferably performed through suction filtration, pressure filtration or the like. While the drying is not particularly limited, it is preferably performed through freeze-drying, flash jet drying, fluidized drying, vibrating fluidized drying or the like from the viewpoint of the productivity.

Examples of the surfactant for use in emulsion polymerization, dispersing of a pigment, dispersing of a releasing agent, aggregation, and stabilization and the like involved in the method of producing the toner of the present aspect of the invention include anionic surfactants such as sulfate ester salts, sulfonate salts, phosphate esters, or soaps; cationic surfactants such as amine salts or quaternary ammonium salts; and the like. In addition, a nonionic surfactant such as polyethylene glycol, an alkylphenol ethylene oxide adduct, or a polyvalent alcohol can be also effectively used in combination of the above surfactants.

Developer

The developer according to one aspect of the invention includes the toner according to one aspect of the invention. The developer is prepared as a one-component developer when the toner is singly used therein, and the developer is prepared as a two-component developer when the toner is used in combination with a carrier. The developer according to one aspect of the invention is preferably a two-component developer.

The carrier used in one exemplary embodiment of the invention is not particularly limited. Examples of the core material of the carrier include magnetic metals such as iron, steel, nickel, and cobalt; alloys thereof with manganese, chromium, a rare earth element, or the like; and magnetic oxides such as ferrite, and magnetite. From the viewpoint of the surface property and the resistance of the core material, preferable examples thereof include ferrite, and specifically preferable examples thereof include alloys of the magnetic metals with manganese, lithium, strontium, magnesium or the like.

The carrier used in one exemplary embodiment of the invention is preferably a carrier wherein the surface of a core material is coated with a covering resin. The covering resin is not particularly limited as long as the covering resin can be used as a matrix resin, and may be selected in accordance with the purpose thereof. The covering resin may be a known resin, and examples thereof include polyolefin resins such as polyethylene, or polypropylene; polyvinyl resins, or polyvinylidene resins such as polystyrene, acrylic resin, polyacrylonitrile, polyvinyl acetal, polyvinyl alcohol, polyvinyl butyral, polyvinyl chloride, polyvinyl carbazole, polyvinyl ether, or polyvinyl ketone; vinyl chloride-vinyl acetate resin; styrene-acrylic acid copolymer; straight silicone resins having organosiloxane bonds, or modified products thereof; fluorine-containing resins such as polytetrafluoroethylene, polyvinyl fluoride, polyvinylidene fluoride, or polychlorotrifluoroethylene; silicone resins; polyesters; polyurethanes; polycarbonates; phenol resins; amino resins such as urea-formaldehyde resin, melamine resin, benzoguanamine resin, urea resin, or polyamide resin; and epoxy resins. These may be used alone or in combination of two or more thereof. In the exemplary embodiment, it is preferable to use at least a fluorine-containing resin and/or a silicone resin as the covering resin. The use of a fluorine-containing resin and/or a silicone resin as the covering resin can be preferable in view of obtaining a highly advantageous effect of preventing carrier contamination (impaction) due to the toner or an external additive.

At least one of resin particles and electroconductive particles are dispersed in the covering resin which forms the covering film. Examples of the resin particles include thermoplastic resin particles and thermosetting resin particles. Of these particles, thermosetting resin particles are preferable since the hardness can be relatively easily increased. In view of providing negative charging characteristic to the toner, resin particles made of a nitrogen-containing resin, which contains nitrogen atoms, can be preferably used. The resin particles may be formed of single species or two or more kinds used in combination. The average particle diameter of the resin particles is preferably from about 0.1 to about 2 μm, more preferably from about 0.2 to about 1 μm. When the average particle diameter of the resin particles is about 0.1 μm or more, the dispersibility of the resin particles in the covering film can be excellent. On the other hand, when the diameter is about 2 μm or less, the resin particles may not fall down easily from the covering film.

Examples of the electroconductive particles include particles of a metal such as gold, silver or copper; carbon black particles; particles of a semiconductive oxide such as titanium oxide or zinc oxide; and particles wherein the surface of powder made of titanium oxide, zinc oxide, barium sulfate, aluminum borate, potassium titanate or the like is coated with tin oxide, carbon black, a metal or the like. A single species of the electroconductive particles can be used, or two or more species thereof may be used together in the exemplary embodiment of the invention. Of these particles, carbon black particles are preferable in view of the production stability, the costs and the electroconductivity thereof and the like. The kind of carbon black is not particularly limited. It is preferable that carbon black has a dibutyl phthalate (DBP) oil absorption of about 50 ml/100 g to about 250 ml/100 g in view of excellent. production stability.

The method for forming the covering film is not particularly limited, and examples thereof include a method using a covering film forming liquid containing, in a solvent, the resin particles and/or the electroconductive particles such as crosslinking resin particles and the resin, such as styrene-acrylic resin, fluorine-containing resin, or silicone resin, as a matrix resin.

Specific examples thereof include an immersing method of immersing the carrier core material into the covering film forming liquid, a spray method of spraying the covering film forming liquid onto the surface of the carrier core material, and a kneader coater method of mixing the covering film forming liquid with the carrier core material while floating the core material by flowing air, and then removing the solvent. Of these methods, the kneader coater method is preferable in the exemplary embodiment.

The solvent used in the covering film forming liquid is not particularly limited as long as the solvent is a solvent in which only the matrix resin can be dissolved, and may be selected from known solvents. Examples thereof include aromatic hydrocarbon solvents such as toluene, and xylene; ketones such as acetone, methyl ethyl ketone; and ethers such as tetrahydrofuran, or dioxane.

Image Forming Method

The image forming method according to one aspect of the invention has at least: latent image-forming to form an electrostatic latent image on a surface of a latent image holder; image forming by developing the electrostatic latent image using an electrophotographic developer held on a surface of a developer holder to form a toner image; transferring the toner image from the surface of the latent image holder to a surface of a transfer-receiving body; and fixing the transferred toner image to the surface of the transfer-receiving body, the electrophotographic developer being the electrophotographic developer of one aspect of the invention.

The developer can be either a one-component developer or a two-component developer. Conventionally-known processes may be used for each of processes included in the image forming method according to one aspect of the invention. The image forming method according to one aspect of the invention may further include on or more processes in addition to the processes described above.

Referring to the attached drawing, the following will describe an example of an image forming device with which the image forming method of the exemplary embodiment can be carried out.

FIG. 1 is a schematic view illustrating an example of the image forming device. In FIG. 1, an image forming machine 100 has a latent image holder 101, an electrifying unit 102, a printing unit 103 for forming an electrostatic latent image, developing units 104*a*, 104*b*, 104*c*, and 104*d* in which developers in colors of black (K), yellow (Y), magenta (M), and cyan (C) are respectively accommodated, a static electricity removal lamp 105, a cleaning unit 106, an intermediate transfer body 107, a transfer roll 108, a fixing roll 109, and a pressing roll 110. The developers accommodated in the developing units 104*a*, 104*b*, 104*c*, and 104*d* each contain the toner of the exemplary embodiment.

Around the latent image holder 101, along the rotating direction (the direction of arrow A) of the latent image holder 101, the following are successively arranged: the electrifying unit 102, which is of a non-contact type and causes the surface of the latent image holder 101 to be electrified; the printing unit 103, which radiates scanning light which corresponds to image data and is shown by arrow L onto the surface of the latent image holder 101, thereby forming an electrostatic latent image on the surface of the latent image holder 101; the developing units 104*a*, 104*b*, 104*c*, and 104*d*, which supply the respective color toners to the electrostatic latent image; the intermediate transfer body 107, which is in a drum form, can contact the surface of the latent image holder 101 and can be passively driven by the rotation in the direction of arrow A of the latent image holder 101 so as to be rotated in the direction of arrow B; the static electricity removal lamp 105, which is a lamp for removing static electricity from the surface of the latent image holder 101; and the cleaning unit 106, which can contact the surface of the latent image holder 101.

The transfer roll 108 is disposed so that it can be controlled to be brought into contact with the surface of the intermediate transfer body 107 and separated therefrom. At the time of the contact, the transfer roll 108 can be trailed by the rotation in the direction of arrow B of the intermediate transfer body 107, so as to be rotated in the direction of arrow C.

Between the intermediate transfer body 107 and the transfer roll 108 a recording medium 111 may be inserted, which is a transfer-receiving body that is conveyed in the direction of arrow N from the upstream side of arrow N by means of a conveying unit that is not illustrated. At the downstream side of the intermediate transfer body 107 along the direction of arrow N, the fixing roll 109, in which a heating source (not illustrated) is included, and the pressing roll 110 are arranged, and a pressure contacting region (nip region) is formed between the fixing roll 109 and the pressing roll 110. The recording medium that has passed through the gap between the intermediate transfer body 107 and the transfer roll 108 can be inserted into the pressure contacting region in the direction of arrow N.

Next, the formation of an image using the image forming device 100 is explained. First, with the rotation of the latent image holder 101 in the arrow A direction, the non-contact electrifying unit 102 electrifies the surface of the latent image holder 101, and the printing unit 103 forms an electrostatic latent image on the electrified surface of the latent image holder 101 in accordance with image data corresponding to the respective colors. In accordance with the color data of the electrostatic latent image, the toner of the exemplary embodiment is supplied from the developing units 104*a*, 104*b*, 104*c* and 104*d* to the latent image holder 101 surface on which the electrostatic latent image is formed, thereby forming a toner image.

Next, a voltage is applied between the latent image holder 101 and the intermediate transfer body 107 from a power source that is not illustrated, whereby the toner image formed on the latent image holder 101 surface is transferred to the surface of the intermediate transfer body 107 at the region at which the latent image holder 101 and the intermediate transfer body 107 contact each other.

Light is radiated from the static electricity removal lamp 105 onto the surface of the latent image holder 101, from which the toner image has been transferred onto the intermediate transfer body 107, to remove the static electricity and, further, the toner remaining on the surface is removed with the cleaning blade of the cleaning unit 106. The process is repeated for each of the respective color images, thereby laminating and forming toner images in the respective colors on the surface of the intermediate transfer body 107 so as to correspond to the image data.

In the above-mentioned process, the transfer roll 108 is in a state of non-contact with the intermediate transfer body 107. When the toner images in all the colors have been laminated and formed on the surface of the intermediate transfer body 107 and are then are transferred onto the recording medium 111, the transfer roll 108 is in a state of contact with the intermediate transfer body 107.

With the rotation of the intermediate transfer body 107 in the direction of arrow B, the toner images laminated and formed on the intermediate transfer body 107 surface are moved to the region at which the intermediate transfer body 107 and the transfer roll 108 contact each other. At this time, the recording medium 111 is inserted into the contact region from the upstream side of arrow N by means of a sheettransporting roll that is not illustrated. Due to a voltage applied between the intermediate transfer body 107 and the transfer roll 108, the toner images laminated and formed on the surface of the intermediate transfer body 107 are transferred together onto the recording medium 111 surface at the contact region.

The recording medium 111, on the surface of which the toner images have been transferred as described above, is conveyed to the nip region between the fixing roll 109 and the pressing roll 110. When the medium 111 passes through the nip region, the medium 111 is heated with the fixing roll 109, the surface of which is heated with the heating source (not illustrated) included in the roll 109. At this time, the toner images are fixed on the recording medium 111 surface, thereby forming an image.

The toner cartridge according to one aspect of the invention is a toner cartridge, which is attachable to and detachable from an image forming machine having a developing means, and stores a toner to be supplied to the developing means, the toner being the electrophotographic toner of one aspect of the invention.

The image forming machine illustrated in FIG. 1 is an image forming machine having a structure wherein toner cartridges 124*a*, 124*b*, 124*c* and 124*d* are attachable thereto and detachable therefrom. The developing units 104*a*, 104*b*, 104*c* and 104*d* are connected to the toner cartridges corresponding to the respective developing units (colors) through the toner supplying pipes 114*a*, 114*b*, 114*c* and 114*d*, respectively.

At the time of the formation of the image in this case, the toners are supplied from the toner cartridges 124*a*, 124*b*, 124*c* and 124*d* corresponding to the respective developing units (colors) through the toner supplying pipes 114*a*, 114*b*, 114*c* and 114*d* to the developing units 104*a*, 104*b*, 104*c* and 104*d*, respectively. Accordingly, images can be formed, using the toner species of the exemplary embodiments for a long period. When the amount of the toner put in any one of the toner cartridges becomes small, the toner cartridge can be exchanged.

EXAMPLES

Hereinafter, the present invention will be described in detail with reference to Examples, while it should be understood that the invention is not restricted thereby. The "part" in the Examples below means "part by mass" unless otherwise specified.

Synthesis of Non-crystalline Polyester Resin

Synthesis Example 1

Synthesis of Resin A1

A mixture containing 97.1 parts of dimethyl terephthalate, 58.3 parts of dimethyl isophthalate, 53.3 parts of dodecenylsuccinic anhydride, 94.9 parts of an ethylene oxide adduct of bisphenol A, 241 parts of a propylene oxide adduct of bisphenol A, and 0.12 part of dibutyltin oxide is stirred at 180° C. for 6 hours under the atmosphere of nitrogen. Thereafter, the mixture is stirred at 220° C. for 5 hours while the pressure is reduced. When the molecular weight of a polyester resin formed in the mixture becomes about 30,000, 8 parts of trimellitic anhydride is further added to the mixture. Furthermore, the mixture is stirred for 2 hours to yield a non-crystalline polyester resin (resin A1) having a weight-average molecular weight (Mw) of 45,900 and a number-average molecular weight (Mn) of 7,900. The glass transition temperature of the resin A1 is 63° C., and the acid value of the resin A1 is 13.6 mgKOH/g.

Synthesis Example 2

Synthesis of Resin A2

A mixture containing 116.5 parts of dimethyl terephthalate, 19.4 parts of dimethyl isophthalate, 79.9 parts of dodecenylsuccinic anhydride, 158.2 parts of an ethylene oxide adduct of bisphenol A, 172.1 parts of a propylene oxide adduct of bisphenol A, and 0.19 part of dibutyltin oxide is stirred at 180° C. for 6 hours under the atmosphere of nitrogen. Thereafter, the mixture is stirred at 220° C. for 5 hours while the pressure is reduced. When the molecular weight of a polyester resin formed in the mixture becomes about 30,000, 8 parts of trimellitic anhydride is further added to the mixture. Furthermore, the mixture is stirred for 2 hours to yield a non-crystalline polyester resin (resin A2) having a weight-average molecular weight (Mw) of 46,100 and a number-average molecular weight (Mn) of 7,400. The glass transition temperature of the resin A2 is 60° C., and the acid value of the resin A2 is 13.5 mgKOH/g.

Synthesis Example 3

Synthesis of Resin A3

A mixture containing 116.5 parts of dimethyl terephthalate, 38.8 parts of dimethyl isophthalate, 53.3 parts of dodecenylsuccinic anhydride, 94.9 parts of an ethylene oxide adduct of bisphenol A, 241 parts of a propylene oxide adduct of bisphenol A, and 0.12 part of dibutyltin oxide is stirred at 180° C. for 6 hours under the atmosphere of nitrogen. Thereafter, the mixture is stirred at 220° C. for 5 hours while the pressure is reduced. When the molecular weight of a polyester resin formed in the mixture becomes about 30,000, 8 parts of trimellitic anhydride is further added to the mixture. Furthermore, the mixture is stirred for 2 hours to yield a non-crystalline polyester resin (resin A3) having a weight-average molecular weight (Mw) of 48,200 and a number-average molecular weight (Mn) of 6,900. The glass transition temperature of the resin A3 is 64° C., and the acid value of the resin A3 is 12.3 mgKOH/g.

Synthesis Example 4

Synthesis of Resin A4

A mixture containing 97.1 parts of dimethyl terephthalate, 58.3 parts of dimethyl isophthalate, 53.3 parts of dodecenylsuccinic anhydride, 158.2 parts of an ethylene oxide adduct of bisphenol A, 172.2 parts of a propylene oxide adduct of bisphenol A, and 0.12 part of dibutyltin oxide is stirred at 180° C. for 6 hours under the atmosphere of nitrogen. Thereafter, the mixture is stirred at 220° C. for 5 hours while the pressure is reduced. When the molecular weight of a polyester resin formed in the mixture becomes about 30,000, 9 parts of trimellitic anhydride is farther added to the mixture. Furthermore, the mixture is stirred for 2 hours to yield a non-crystalline polyester resin (resin A4) having a weight-average molecular weight (Mw) of 45,500 and a number-average molecular weight (Mn) of 6,300. The glass transition temperature of the resin A4 is 63° C., and the acid value of the resin A4 is 15.5 mgKOH/g.

Synthesis Example 5

Synthesis of Resin B1

A mixture containing 97.1 parts of dimethyl terephthalate, 38.8 parts of dimethyl isophthalate, 79.9 parts of dodecenylsuccinic anhydride, 94.9 parts of an ethylene oxide adduct of bisphenol A. 241 parts of a propylene oxide adduct of bisphenol A, and 0.12 part of dibutyltin oxide is stirred at 180° C. for 6 hours under the atmosphere of nitrogen. Thereafter, the mixture is stirred at 220° C. for 2 hours while the pressure is reduced. When the molecular weight of a polyester resin formed in the mixture becomes about 12,000, 9 parts of trimellitic anhydride is further added to the mixture. Furthermore, the mixture is stirred for 1 hour to yield a non-crystalline polyester resin (resin B1) having a weight-average molecular weight (Mw) of 14,500 and a number-average molecular weight (Mn) of 5,300. The glass transition temperature of the resin B1 is 61° C., and the acid value of the resin B1 is 15.5 mgKOH/g.

Synthesis Example 6

Synthesis of Resin B2

A mixture containing 97.1 parts of dimethyl terephthalate, 58.3 parts of dimethyl isophthalate, 53.3 parts of dodecenylsuccinic anhydride, 158.2 parts of an ethylene oxide adduct of bisphenol A, 172.2 parts of a propylene oxide adduct of bisphenol A, and 0.12 part of dibutyltin oxide is stirred at 180° C. for 6 hours under the atmosphere of nitrogen. Thereafter, the mixture is stirred at 220° C. for 2 hours while the pressure is reduced. When the molecular weight of a polyester resin formed in the mixture becomes about 12,000, 9 parts of trimellitic anhydride is further added to the mixture. Furthermore, the mixture is stirred for 1 hour to yield a non-crystalline polyester resin (resin B2) having a weight-average molecular weight (Mw) of 17,700 and a number-average molecular weight (Mn) of 5,700. The glass transition temperature of the resin B2 is 64° C., and the acid value of the resin B2 is 15.2 mgKOH/g.

Synthesis Example 7

Synthesis of Resin B3

A mixture containing 97.1 parts of dimethyl terephthalate, 48.5 parts of dimethyl isophthalate, 66.6 parts of dodecenylsuccinic anhydride, 221.4 parts of an ethylene oxide adduct of bisphenol A, 103.3 parts of a propylene oxide adduct of bisphenol A, and 0.12 part of dibutyltin oxide is stirred at 180° C. for 6 hours under the atmosphere of nitrogen. Thereafter, the mixture is stirred at 220° C. for 2 hours while the pressure is reduced. When the molecular weight of a polyester resin formed in the mixture becomes about 12,000, 9 parts of trimellitic anhydride is further added to the mixture. Furthermore, the mixture is stirred for 1 hour to yield a non-crystalline polyester resin (resin B3) having a weight-average molecular weight (Mw) of 16,100 and a number-average molecular weight (Mn) of 6,200. The glass transition temperature of the resin B3 is 63° C., and the acid value of the resin B3 is 15.8 mgKOH/g.

Synthesis Example 8

Synthesis of Resin B4

A mixture containing 97.1 parts of dimethyl terephthalate, 48.5 parts of dimethyl isophthalate, 66.6 parts of dodecenylsuccinic anhydride, 158.2 parts of an ethylene oxide adduct of bisphenol A, 172.2 parts of a propylene oxide adduct of bisphenol A, and 0.12 part of dibutyltin oxide is stirred at 180° C. for 6 hours under the atmosphere of nitrogen. Thereafter, the mixture is stirred at 220° C. for 2 hours while the pressure is reduced. When the molecular weight of a polyester resin formed in the mixture becomes about 12,000, 9 parts of trimellitic anhydride is further added to the mixture. Furthermore, the mixture is stirred for 1 hour to yield a non-crystalline polyester resin (resin B4) having a weight-average molecular weight (Mw) of 15,900 and a number-average molecular weight (Mn) of 5,400. The glass transition temperature of the resin B4 is 63° C., and the acid value of the resin B4 is 12.1 mgKOH/g.

Synthesis of Crystalline Polyester Resin

Synthesis Example 1

Synthesis of Resin C1

A mixture of 230.3 parts of dodecanedioic acid, 174.3 parts of 1,10-decanediol, and 0.12 part of dibutyltin oxide is stirred at 180° C. for 6 hours under the atmosphere of nitrogen. Thereafter, the mixture is stirred for 4 hours while the pressure is reduced to yield a is a crystalline polyester resin (resin C1) having a weight-average molecular weight (Mw) of 16,700, a number-average molecular weight (Mn) of 6,500, and an acid value of 12.4 mgKOH/g. The ester concentration of the resin C1 is 0.083, and the melting temperature of the resin C1 is 86° C.

Synthesis Example 2

Synthesis of Resin C2

A mixture of 230.3 parts of dodecanedioic acid, 160.3 parts of 1,9-nonanediol, and 0.12 part of dibutyltin oxide is stirred at 180° C. for 6 hours under the atmosphere of nitrogen. Thereafter, the mixture is stirred for 4 hours while the pressure is reduced to yield a is a crystalline polyester resin (resin C2) having a weight-average molecular weight (Mw) of 24,200, a number-average molecular weight (Mn) of 9,900, and an acid value of 10.8 mgKOH/g. The ester concentration of the resin C2 is 0.087, and the melting temperature of the resin C2 is 77° C.

Synthesis Example 3

Synthesis of Resin C3

A mixture of 248 parts of tetradecanedioic acid, 118.2 parts of 1,6-hexanediol, and 0.12 part of dibutyltin oxide is stirred at 180° C. for 6 hours under the atmosphere of nitrogen. Thereafter, the mixture is stirred for 4 hours while the pressure is reduced to yield a is a crystalline polyester resin (resin C3) having a weight-average molecular weight (Mw) of 25,500, a number-average molecular weight (Mn) of 10,400, and an acid value of 11.5 mgKOH/g. The ester concentration of the resin C3 is 0.091, and the melting temperature of the resin C3 is 75° C.

Synthesis Example 4

Synthesis of Resin C4

A mixture of 241.8 parts of dodecanedioic acid, 174.3 parts of 1,10-decanediol, and 0.12 part of dibutyltin oxide is stirred at 180° C. for 6 hours under the atmosphere of nitrogen. Thereafter, the mixture is stirred for 4 hours while the pressure is reduced to yield a is a crystalline polyester resin (resin C4) having a weight-average molecular weight (Mw) of 17,500, a number-average molecular weight (Mn) of 6,200, and an acid value of 15.6 mgKOH/g. The ester concentration of the resin C4 is 0.083, and the melting temperature of the resin C4 is 86° C.

Synthesis Example 5

Synthesis of Resin C5

A mixture of 253.3 parts of dodecanedioic acid, 160.3 parts of 1,9-nonanediol, and 0.12 part of dibutyltin oxide is stirred at 180° C. for 6 hours under the atmosphere of nitrogen. Thereafter, the mixture is stirred for 4 hours while the pressure is reduced to yield a is a crystalline polyester resin (resin C5) having a weight-average molecular weight (Mw) of 23,600, a number-average molecular weight (Mn) of 8,300, and an acid value of 15.8 mgKOH/g. The ester concentration of the resin C5 is 0.087, and the melting temperature of the resin C5 is 77° C.

Synthesis Example 6

Synthesis of Resin C6

A mixture of 253.3 parts of tetradecanedioic acid, 118.2 parts of 1,6-hexanediol, and 0.12 part of dibutyltin oxide is stirred at 180° C. for 6 hours under the atmosphere of nitrogen. Thereafter, the mixture is stirred for 4 hours while the pressure is reduced to yield a is a crystalline polyester resin (resin C6) having a weight-average molecular weight (Mw) of 23,400, a number-average molecular weight (Mn) of 9,400, and an acid value of 16.2 mgKOH/g. The ester concentration of the resin C6 is 0.091, and the melting temperature of the resin C6 is 75° C.

Production of Emulsion

Production of Exemplary Emulsion 1 (Production of Resin Latex (D1))

300 parts of the resin A1, 120 parts of ethyl acetate, and 75 parts of isopropyl alcohol are mixed to solve the resin at room temperature (25° C.). After adding 10.4 parts of 10% aqueous ammonia thereto, 1,200 parts of ion exchange water is slowly added in a dropwise manner to the mixture so that the resultant causes phase inversion to yield an emulsion. Ethyl acetate and isopropyl alcohol contained in the emulsion are distilled off to yield a resin latex D1 having a volume-average particle diameter of 0.17 μm.

Production of Exemplary Emulsion 2 (Production of Resin Latex (D2))

A resin latex D2 having a volume-average particle diameter of 0.16 μm is obtained in a manner substantially similar to that of the resin latex D1, except that the resin A2 is used in place of the resin A1.

Production of Exemplary Emulsions 3 and 4 (Production of Resin Latexes (D3 and D4))

Resin latexes D3 and D4 are obtained in a manner substantially similar to that of the resin latex D1, except that the resin A3 and the resin A4 are respectively used in place of the resin A1 as shown in the following Table 1. The volume-average particle diameters of the resin latexes D3 and D4 measured are also shown in Table 1.

Production of Exemplary Emulsion 5 (Production of Resin Latex (E1))

300 parts of the resin B1, 120 parts of ethyl acetate, and 75 parts of isopropyl alcohol are mixed to solve the resin at room temperature (25° C.). After adding 10.4 parts of 10% aqueous ammonia thereto, 1,200 parts of ion exchange water is slowly added in a dropwise manner to the mixture so that the resultant causes phase inversion to yield an emulsion. Ethyl acetate and isopropyl alcohol contained in the emulsion are distilled off to yield a resin latex E1 having a volume-average particle diameter of 0.15 μm.

Production of Exemplary Emulsions 6 to 8 (Production of Resin Latexes (E2 to E4))

Resin latexes E2 to E4 are obtained in a manner substantially similar to that of the resin latex E1, except that the resins B2 to B4 are respectively used in place of the resin B1 as shown in the following Table 1. The volume-average particle diameters of the resin latexes B2 to B4 measured are also shown in Table 1.

Production of Exemplary Emulsion 9 (Production of Resin Latex (F1))

300 parts of the resin C1, 105 parts of ethyl acetate, and 105 parts of isopropyl alcohol are mixed to solve the resin at 65° C. After adding 15.5 parts of 10% aqueous ammonia thereto, 1,200 parts of ion exchange water is slowly added in a dropwise manner to the mixture so that the resultant causes phase inversion to yield an emulsion. Ethyl acetate and isopropyl alcohol contained in the emulsion are distilled off to yield a resin latex F1 having a volume-average particle diameter of 0.14 μm.

Production of Exemplary Emulsions 10 to 14 (Production of Resin Latexes (F2 to F6)

Resin latexes F2 to F6 are obtained in a manner substantially similar to that of the resin latex F1, except that the resins C2 to C6 are respectively used in place of the resin C1 as shown in the following Table 1. The volume-average particle diameters of the resin latexes F2 to F6 measured are also shown in Table 1.

Each of the resin latexes has a solid content of 20 mass % relative to a total amount of each of the resin latexes.

TABLE 1

| | Resin latex | | | | | | | | | | | | | |
|---|---|---|---|---|---|---|---|---|---|---|---|---|---|---|
| | D1 | D2 | D3 | D4 | E1 | E2 | E3 | E4 | F1 | F2 | F3 | F4 | F5 | F6 |
| | Resin | | | | | | | | | | | | | |
| | A1 | A2 | A3 | A4 | B1 | B2 | B3 | B4 | C1 | C2 | C3 | C4 | C5 | C6 |
| Volume-average particle diameter (μm) | 0.17 | 0.16 | 0.16 | 0.15 | 0.15 | 0.16 | 0.16 | 0.17 | 0.14 | 0.13 | 0.14 | 0.12 | 0.12 | 0.12 |

Preparation of Pigment Dispersion

The following formulation is mixed and dispersed by a homogenizer (trade name. ULTRA TURRAX 50, manufactured by IKA) and ultrasonic wave irradiation so as to obtain a dispersion of a blue pigment having a volume-average diameter of 150 nm.

Formulation of Pigment Dispersion:

| | |
|---|---|
| Cyan pigment: C.I. Pigment Blue 15:3 (copper phthalocyanine, manufactured by Dainippon Ink and Chemicals, Inc.) | 50 parts |
| Anionic surfactant: Neogen SC (trade name, manufactured by Daiichi Kogyo Seiyaku Co., Ltd.) | 5 parts |
| Ion-exchange water | 200 parts |

Preparation of Releasing Agent Dispersion

The following formulation is mixed, heated to 97° C., and dispersed by a homogenizer (trade name: ULTRA TURRAX 50, manufactured by IKA). The resultant is further processed by a Gaulin homogenizer (manufactured by Meiwa Shoji Co., Ltd.) 20 times under the condition of 105° C. and 550 kg/$cm_2$ to pulverize the content of the resultant, and a releasing agent dispersion containing particles having a volume-average diameter of 190 nm is obtained thereby.

Formulation of Releasing Agent Dispersion:

| | |
|---|---|
| Wax (trade name: WEP-5, manufactured by NOF Corporation) | 50 parts |
| Anionic surfactant: Neogen SC (described above) | 5 parts |
| Ion-exchange water | 200 parts |

Example 1

Preparation of Electrophotographic Toner (1)

The following formulation is mixed and dispersed in a round stainless steel flask with a homogenizer (trade name: ULTRA TURRAX 50, manufactured by IKA), and the resulted content in the flask is heated to 45° C. while stirred and kept at 45° C. for 30 minutes.

| | |
|---|---|
| Resin latex (D1) | 195 parts |
| Resin latex (E1) | 195 parts |
| Resin latex (F1) | 65 parts |
| Ion-exchange water | 250 parts |
| Pigment dispersion | 33.5 parts |
| Releasing-agent dispersion | 67.5 parts |
| Aqueous solution of aluminum sulfate (10%, manufactured by Asada Chemicals) | 75 parts |

After the heating, stirring and keeping, 105 parts of the resin latex (D1) and 105 parts of the resin latex (E1) are added to the resultant, and stirring are conducted for 30 minutes. Observation of the thus obtained content under an optical microscope reveals that aggregate particles having a particle diameter of approximately 6.5 μm are formed. A pH of the content is then adjusted to 7.5 by addition of an aqueous sodium hydroxide solution, and then heated to 90° C. and maintained for approximately 2 hour for allowing melt-coalescing of the aggregates; after cooling, the resulting particles are filtered, thoroughly washed with ion-exchange water, and dried, to give a toner particle (1). The volume-average particle diameter of the toner particle (1) as measured by the above-described method is 6.4 μm. The index of volume-average particle diameter distribution (GSDv) of toner particle (1) is turned out to be 1.22.

0.5% of hexamethyldisilazane-treated silica (volume-average diameter: 40 nm) and 0.7% of a titanium compound prepared by treating meta-titanic acid with isobutyltrimethoxylsilane (concentration: 50%) and calcinating (volume-average diameter: 30 nm) are added to the toner particle (1) particles as external additives (each weight ratios of the external additives are expressed with respect to the amount of the toner particle (1)), and the mixture is blended in a 75-L Henschel Mixer for 10 minutes, and then screened in an air classifier (trade name: HIGH BOLTER 300, manufactured by Shin-Tokyo Kikai Co., ltd.) to give an electrophotographic toner particle (1).

50 g of the electrophotographic toner is put into 500 ml of toluene. The resultant is stirred at room temperature (25° C.) for 5 hours. Insoluble matter present in the resultant is then filtrated and dried under reduced pressure to yield a solid matter. Toluene is distilled off from the toluene-soluble matter dissolved in the resultant, and the toluene-soluble matter is again dissolved into tetrahydrofuran. The solution is subjected to separating treatment by GPC fractionation. A fraction having a molecular weight of 30,000 to 100,000, as measured by gel permeation chromatography relative to polystyrene standards, is collected and concentrated to yield 500 mg of a sample. The acid value of this sample is measured to turn out to be 12.3 mgKOH/g. A fraction having a molecular weight of 8,000 to 12,000, as measured by gel permeation chromatography relative to polystyrene standards, is collected and concentrated to yield 500 mg of a sample. The acid value of this sample is measured to turn out to be 15.4 mgKOH/g. On the other hand, toluene is distilled off from the toluene-insoluble matter obtained from the resultant, and the toluene-insoluble matter is again dissolved into tetrahydrofuran. The solution is subjected to separating treatment by GPC fractionation. A fraction having a molecular weight of 1,000 or more, as measured by gel permeation chromatography relative to polystyrene standards, is collected and concentrated to yield 500 mg of a sample. The acid value of this sample is measured to turn out to be 11.2 mgKOH/g.

Preparation of Electrophotographic Developer (1)

A carrier is obtained by coating 0.15 part of vinylidene fluoride and 1.35 parts of a copolymer resin of methyl methacrylate and trifluoroethylene (polymerization ratio: 80:20) to 100 parts of a ferrite core having an average diameter of 50 μm by using a kneader. The thus obtained carrier and the electrophotographic toner particle (1) are blended at a ratio of 100 parts to 8 parts by using a 2-L V blender to give an electrophotographic developer (1).

Evaluation of Image Streaks

With respect to the prepared electrophotographic developer (1), a remodeled device of the DocuCentre Colorf 450 device manufactured by Fuji Xerox Co., Ltd. is used to conduct an image forming test using a test pattern (image region: 20%; non-image region: 80%) at a process speed of 165 mm/s, 28° C., and a humidity of 80%.

Over 2 hours, images based on the test pattern are printed onto 4000 sheets. Thereafter, the image forming device is turned off, and then allowed to stand for 8 hours. The image forming device is then turned on again to restart printing. The state of the first printed image after the printing is restarted is evaluated with the naked eye on the basis of the criteria described below. This evaluation is repeated 5 times. The evaluation results are shown in Table 2. Levels from G0 to G4 are practically allowable levels.

G0: The image is equivalent to the test pattern, and no streaks are observed on the non-image region.

G2: Faint streaks are observed in a very small area of the non-image region.

G4: Faint streaks are observed in half of the non-image region.

G6: Faint streaks are observed in the whole of the non-image region.

G8: Streaks are clearly observed in half of the non-image region.

G10: Streaks are clearly observed in the whole of the non-image region.

About the electrophotographic developer (1), no streak is observed even after images are printed on 20000 sheets (after the 5th evaluation). Thus, the developer is at a level of G0.

Examples 2 to 8

Electrophotographic toners and electrophotographic developers of Examples 2 to 8 are prepared in a similar manner as those of Example 1, except that each of the following compositions shown in Table 2 is used in place of the resin latex used in preparing the toner in Example 1. Further, the electrophotographic toners and electrophotographic developers are subjected to the evaluations similarly to Example 1. The results of the evaluations are shown in Table 2.

In Example 7, the resin latex (D1), the resin latex (E1) and the resin latex (F1) used in the firstly-mixed and dispersed formulation are changed to 208 parts of the resin latex (D3), 208 parts of the resin latex (E2) and 38 parts of the resin latex (F2) respectively, and the added resin latex (D1) is changed to 105 parts of a resin latex (D3) and 105 parts of a resin latex (E2).

In Example 8, the resin latex (D1), the resin latex (E1) and the resin latex (F1) used in the firstly-mixed and dispersed formulation are changed to 175 parts of the resin latex (D2), 208 parts of the resin latex (E3) and 38 parts of the resin latex (F3) respectively, and the added resin latex (D1) is changed to 105 parts of a resin latex (D2) and 105 parts of a resin latex (E3).

Comparative Examples 1 to 5 and Examples 9 and 10

Electrophotographic toners and electrophotographic developers of Comparative examples 1 to 5 and Examples 9 and 10 are prepared in a similar manner as those of Example 1, except that each of the following compositions shown in Table 3 is used in place of the resin latex used in preparing the toner in Example 1. Further, the electrophotographic toners and electrophotographic developers are subjected to the evaluations similarly to Example 1. The results of the evaluations are shown in Table 3.

In Example 9, the amounts of the resin latex (D1) and the resin latex (E1) used in the firstly-mixed and dispersed formulation are adjusted to 390 parts and 65 parts respectively, and the amount of the added resin latex (D1) is adjusted to 210 parts.

In Example 10, the amounts of the resin latex (D1) and the resin latex (E1) used in the firstly-mixed and dispersed formulation are adjusted to 390 parts and 65 parts respectively, and the amount of the added resin latex (E1) is adjusted to 210 parts.

The volume-average particle diameter and the volume-average diameter distribution index (GSDv) of each of the electrophotographic toners formed in the examples are respectively the same as those of the electrophotographic toner used for forming thereof.

TABLE 2

| | Example 1 Toner 1 | Example 2 Toner 2 | Example 3 Toner 3 | Example 4 Toner 4 | Example 5 Toner 5 | Example 6 Toner 6 | Example 7 Toner 7 | Example 8 Toner 8 |
|---|---|---|---|---|---|---|---|---|
| Resin latex containing a non-crystalline polyester resin (H resin) (content by percentage) | D1 (45) | D1 (45) | D1 (45) | D2 (45) | D3 (45) | D2 (45) | D3 (47) | D2 (42) |
| Resin latex containing a non-crystalline polyester resin (L resin) (content by percentage) | E1 (45) | E2 (45) | E3 (45) | E1 (45) | E2 (45) | E2 (45) | E2 (47) | E3 (42) |
| Resin latex containing a crystalline polyester resin (content by percentage) | F1 (10) | F2 (10) | F1 (10) | F2 (10) | F3 (10) | F2 (10) | F2 (6) | F3 (16) |
| Volume-average particle diameter (μm) | 6.4 | 6.4 | 6.3 | 6.5 | 6.4 | 6.6 | 6.4 | 6.6 |
| GSDv | 1.22 | 1.23 | 1.23 | 1.21 | 1.22 | 1.22 | 1.23 | 1.21 |
| Acid value C of a resin fraction contained in toluene-insoluble matters | 11.2 | 9.5 | 10.5 | 9.2 | 10 | 9.3 | 8.4 | 10.3 |
| Acid value A of a resin fraction contained in toluene-soluble matters and having a Mw of 30000 to 100000 | 12.3 | 11.9 | 12.7 | 12.4 | 12.6 | 12.3 | 12.5 | 12.2 |
| Acid value B of a resin fraction contained in toluene-soluble matters and having a Mw of 8000 to 120000 | 15.4 | 15.2 | 15.3 | 15.2 | 15.5 | 15 | 14.8 | 15.1 |
| First-printed-image state after printing on 4000 sheets (1st evaluation) | G0 | G0 | G0 | G0 | G0 | G0 | G0 | G0 |
| First-printed-image state after printing on 8000 sheets (2 evaluation) | G0 | G0 | G0 | G0 | G0 | G0 | G0 | G0 |
| First-printed-image state after printing on 12000 sheets ($3^{rd}$ evaluation) | G0 | G0 | G0 | G0 | G0 | G0 | G0 | G0 |
| First-printed-image state after printing on 16000 sheets ($4^{th}$ evaluation) | G0 | G0 | G2 | G0 | G2 | G0 | G0 | G2 |
| First-printed-image state after printing on 20000 sheets ($5^{th}$ evaluation) | G0 | G2 | G2 | G0 | G2 | G2 | G2 | G2 |

TABLE 3

| | Comparative Example 1 Toner 9 | Comparative Example 2 Toner 10 | Comparative Example 3 Toner 11 | Comparative Example 4 Toner 12 | Comparative Example 5 Toner 13 | Example 9 Toner 14 | Example 10 Toner 15 |
|---|---|---|---|---|---|---|---|
| Resin latex containing a non-crystalline polyester resin (H resin) (content by percentage) | D4 (45) | D1 (45) | D4 (45) | D1 (45) | D1 (45) | D1 (90) | — |
| Resin latex containing a non-crystalline polyester resin (L resin) (content by percentage) | E4 (45) | E4 (45) | E4 (45) | E1 (45) | E1 (45) | — | E1 (90) |
| Resin latex containing a crystalline polyester resin (content by percentage) | F1 (10) | F4 (10) | F5 (10) | F6 (10) | F1 (10) | F1 (10) | F1 (10) |
| Volume-average particle diameter (μm) | 6.3 | 6.2 | 6.4 | 6.4 | 6.5 | 6.3 | 6.2 |
| GSDv | 1.22 | 1.23 | 1.23 | 1.22 | 1.23 | 1.23 | 1.23 |
| Acid value C of a resin fraction contained in toluene-insoluble matters | 11.5 | 14.8 | 14.6 | 15 | 11.5 | 11.2 | 11.5 |
| Acid value A of a resin fraction contained in toluene-soluble matters and having a Mw of 30000 to 100000 | 14.5 | 12.3 | 14.3 | 12.5 | 14.8 | 13.0 | 14.0 |
| Acid value B of a resin fraction contained in toluene-soluble matters and having a Mw of 8000 to 120000 | 12.2 | 12.1 | 12.5 | 14.2 | 14.1 | 14.0 | 15.5 |
| First-printed-image state after printing on 4000 sheets (1st evaluation) | G0 | G0 | G0 | G0 | G0 | G0 | G0 |
| First-printed-image state after printing on 8000 sheets ($2^{nd}$ evaluation) | G0 | G2 | G2 | G2 | G0 | G0 | G0 |
| First-printed-image state after printing on 12000 sheets ($3^{rd}$ evaluation) | G2 | G4 | G4 | G4 | G2 | G2 | G2 |
| First-printed-image state after printing on 16000 sheets ($4^{th}$ evaluation) | G2 | G6 | G6 | G6 | G4 | G2 | G2 |
| First-printed-image state after printing on 20000 sheets ($5^{th}$ evaluation) | G6 | G10 | G10 | G10 | G6 | G4 | G4 |

As is evident from Tables 2 and 3, the toners of Examples can maintain the capacity to provide high image quality upon image formation at high temperature and high humidity over a long term since the polyester resins forming the toners satisfy the specific conditions of the invention regarding the molecular weights and acid values thereof. In particular, use of each of the toner of the examples reduces the occurrence of streak-form image defects when an image is initially printed after the toner is allowed to stand at high humidity for a long period.

APPENDIX

Japanese Patent Application Laid-Open (JP-A) No. 2004-191623 teaches using a crystalline resin and a non-crystalline resin in combination for providing toner strength.

JP-A No. 2005-77784 teaches a toner containing a crystalline resin and a non-crystalline resin used in combination as binder resins in which the acid value of the non-crystalline resin is made higher than that of the crystalline resin.

Further, JP-A No. 2006-106727 teaches a technique for controlling the state in which a polyester resin is present on a surface layer or inside of a toner by adjusting the acid value of the resin.

What is claimed is:

1. An electrophotographic toner comprising: a crystalline polyester resin; a non-crystalline polyester resin; a colorant; and a releasing agent, a weight-average molecular weight of the crystalline polyester is from about 15,000 to about 25,500, the non-crystalline polyester resin comprising a non-crystalline polyester resin having a weight-average molecular weight of about 9,000 to about 20,000 as measured by gel permeation chromatography and having an acid value of about 13 mgKOH/g to about 20 mgKOH/g, and a non-crystalline polyester resin having a weight-average molecular weight of about 25,000 to about 55,000 as measured by gel permeation chromatography and having an acid value of about 10 mgKOH/g to about 15 mgKOH/g, the non-crystalline polyester resin comprising a resin fraction (i) and a resin fraction (ii), wherein:

the resin fraction (i) is included in a toluene-soluble component of the toner and is collected as a resin in a fraction having a molecular weight of about 30,000 to about 100,000 relative to polystyrene standards by separating treatment by gel permeation chromatography, and has an acid value A; and the resin fraction (ii) is included in the toluene-soluble component of the toner and is collected as a resin in a fraction having a molecular weight of about 8,000 to about 12,000 relative to polystyrene standards by separating treatment by gel permeation chromatography, and has an acid value B;

the crystalline polyester resin comprising a resin fraction (iii) that is included in a toluene-insoluble component of the toner and has an acid value C, and the acid values A, B, and C satisfying the inequation of B>A>C.

2. The electrophotographic toner of claim 1, wherein the crystalline polyester resin has an ester concentration M calculated by the following equation in a range of about 0.07 to about 0.09:

$$\text{Ester concentration } (M) = K/J$$

wherein, in the above equation, K represents an ester group number in the crystalline polyester resin; and J represents a number of atoms which constitute the polymer chain of the crystalline polyester resin.

3. The electrophotographic toner of claim 1, wherein an amount of the crystalline polyester resin is in a range of about 4 mass % to about 25 mass % relative to a total of the amount of the binder resins.

4. The electrophotographic toner of claim 1, wherein an amount of an aliphatic diol-derived constituent component among all alcohol-derived constituent components included in the crystalline polyester resin is about 80 constituent mole % or more.

5. The electrophotographic toner of claim 1, wherein an acid value of the crystalline polyester resin is in a range of about 7 mgKOH/g to about 15 mgKOH/g.

6. The electrophotographic toner of claim 1, wherein an amount of the releasing agent is in a range of about 3% by mass to about 30% by mass relative to the total amount of the electrophotographic toner.

7. The electrophotographic toner of claim 1, wherein the electrophotographic toner is formed by a method comprising:

providing a non-crystalline polyester resin particle dispersion liquid having non-crystalline polyester resin particles dispersed therein;

providing a crystalline polyester resin particle dispersion liquid having crystalline polyester resin particles dispersed therein;

providing a colorant particle dispersion liquid having colorant particles dispersed therein;

providing a releasing agent particle dispersion liquid having releasing agent particles dispersed therein;

forming aggregated particles comprising the non-crystalline polyester resin particles, the crystalline polyester resin particles, the colorant particles and the releasing agent particles by mixing the non-crystalline polyester resin particle dispersion liquid, the crystalline polyester resin particle dispersion liquid, the colorant particle dispersion liquid and the releasing agent particle dispersion liquid; and melt-coalescing the aggregated particles by heating.

8. An electrophotographic developer comprising the electrophotographic toner of claim 1 and a carrier.

9. The electrophotographic developer of claim 8, wherein the carrier has a covering film formed of a covering resin, and the covering resin has at least one selected from the group consisting of resin particles and electroconductive particles dispersed therein.

10. The electrophotographic developer of claim 9, wherein an average particle diameter of the resin particles is in a range of about 0.1 mm to about 2 mm.

11. The electrophotographic developer of claim 9, wherein the electroconductive particles are carbon black particles.

12. The electrophotographic developer of claim 11, wherein the carbon black has a dibutyl phthalate (DBP) oil absorption of about 50 ml/100 g to about 250 ml/100 g.

13. The electrophotographic developer of claim 8, wherein an acid value of the crystalline polyester resin is in a range of about 7 mgKOH/g to about 15 mgKOH/g.

14. A toner cartridge, which is attachable to and detachable from an image forming machine having a developing means, and stores a toner to be supplied to the developing means, the toner being the electrophotographic toner of claim 1.

15. The toner cartridge of claim 14, wherein an acid value of the crystalline polyester resin is in a range of about 7 mgKOH/g to about 15 mgKOH/g.

16. An image forming method, comprising:

latent image-forming to form an electrostatic latent image on a surface of a latent image holder;

image forming by developing the electrostatic latent image using an electrophotographic developer held on a surface of a developer holder to form a toner image;

transferring the toner image from the surface of the latent image holder to a surface of a transfer-receiving body; and fixing the transferred toner image to the surface of the transfer-receiving body, the electrophotographic developer comprising the electrophotographic toner of claim 1 and a carrier.

17. The image forming method of claim 16, wherein an acid value of the crystalline polyester resin is in a range of about 7 mgKOH/g to about 15 mgKOH/g.

* * * * *